United States Patent [19]

Atalla

[11] Patent Number: 4,577,779

[45] Date of Patent: Mar. 25, 1986

[54] CURRENCY-DISPENSING METHOD AND APPARATUS

[75] Inventor: Martin M. Atalla, Atherton, Calif.

[73] Assignee: Atalla Corporation, San Jose, Calif.

[21] Appl. No.: 567,688

[22] Filed: Jan. 3, 1984

Related U.S. Application Data

[63] Continuation-in-part of Ser. No. 446,074, Dec. 1, 1982, Pat. No. 4,515,288.

[51] Int. Cl.[4] ..... B65H 5/28

[52] U.S. Cl. ..... 221/1; 221/210

[58] Field of Search ..... 221/1, 71, 74, 72, 73, 221/210; 194/4 C, 4 R; 156/DIG. 46, 361

[56] References Cited

U.S. PATENT DOCUMENTS

| | | | |
|---|---|---|---|
| 3,436,294 | 4/1969 | Marano | 156/361 X |
| 3,450,307 | 6/1969 | Sutton | 221/74 |
| 4,091,987 | 5/1978 | Cone | 221/73 X |
| 4,337,864 | 7/1982 | McLean | 221/71 X |

*Primary Examiner*—Stanley H. Tollberg
*Attorney, Agent, or Firm*—A. C. Smith

[57] ABSTRACT

Method and means of supplying currency includes assembling and packing currency on a transport medium which is secured within a housing and which is incrementally unpacked under security control to dispense the desired amount of currency. Method and means for assembling and packing currency on the transport medium include adhesive regions on the transport medium for attaching currency thereto in substantially coplanar array to facilitate selective unpacking by non-coplanar manipulation of currency and transport medium. Another embodiment utilizes packets of currency that move along with the adhesive transport medium to facilitate self-contained assembly of units of currency on the transport medium. Equal rates of movement of the next unit of currency and the transport medium assure that only the next unit of currency will be transported on the adhesive medium.

7 Claims, 7 Drawing Figures

CURRENCY-DISPENSING METHOD AND APPARATUS

RELATED CASES

This application is a continuation-in-part application of pending application Ser. No. 446,074, filed 12/1/82, now U.S. Pat. No. 4,515,288 entitled "CURRENCY-DISPENSING METHOD AND APPARATUS."

BACKGROUND OF THE INVENTION

Vending machines are commonly used to dispense diverse types and forms of goods, and such machines have even been adapted to dispense packets of cash in predetermined amounts. The popularity of dispensing cash packets seems to be attributable to the simplicity of debiting fixed amounts and to the convenience of using dispensing technology which is similar to the technology used in dispensing such packaged goods as cigarettes and candy bars. Machines of this type are disclosed in the literature (see, for example, U.S. Pat. Nos. 3,662,343 and 3,845,277). One disadvantage associated with conventional cash-dispensing machines is that the packets of cash remain highly vulnerable to pilferage in the course of manually inserting cash into packets and in the course of loading packets into the dispensing machines.

It is highly desirable to obviate the manual handling of cash (or other forms of money, like traveler's checks, etc.) in the preparation of the cash for dispensing and in the loading of the cash supply into a dispenser. Also, it is highly desirable to dispense cash (or currency, generally) in arbitrary amounts for greater versatility and accounting possibilities with respect to a recipient's own account balance.

SUMMARY OF THE INVENTION

In accordance with one embodiment of the present invention, cash or other currency to be dispensed is packaged automatically under secured conditions in continuous array on a transport medium which is assembled within a secure housing to form a currency cartridge which can only be operated under coded control to dispense arbitrary amounts of currency, as desired by users. In another embodiment of the present invention, the units of currency to be dispensed are loaded onto the transport medium internally and incrementally as the currency is being dispensed. This obviates the need for an additional secured workstation external to the dispensing apparatus and also reduces operating costs of the apparatus.

DESCRIPTION OF THE PREFERRED EMBODIMENT

Figure 1:
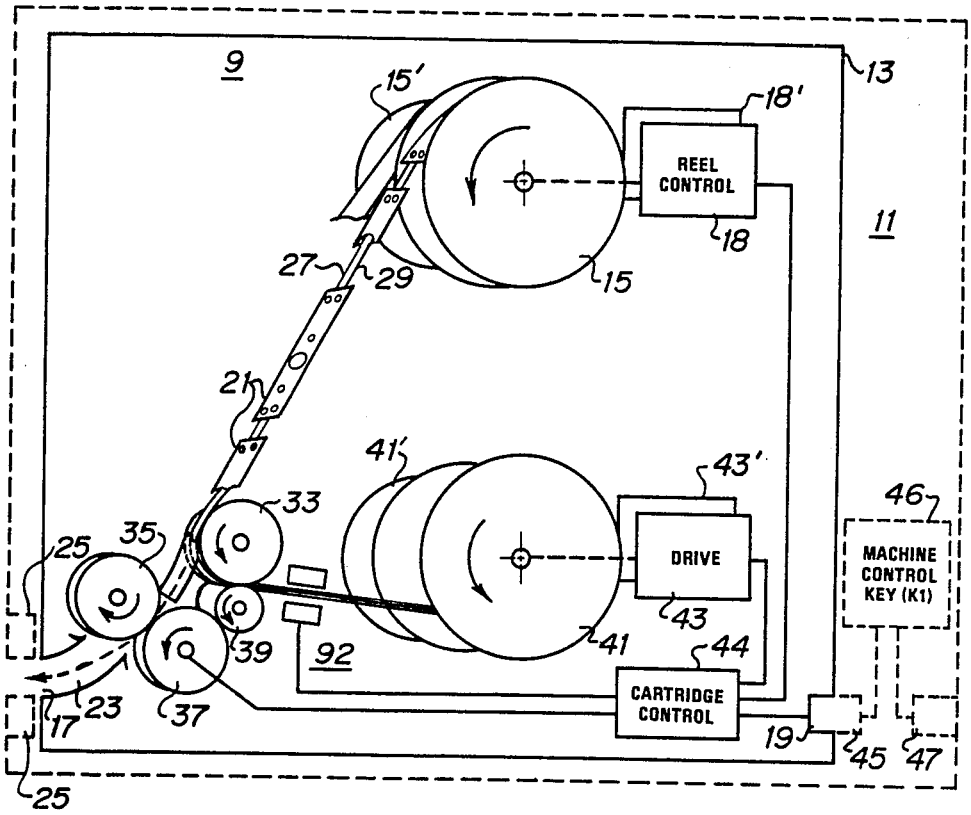
FIG. 1 is a pictorial view of a currency cartridge showing the operating relationships of the structure.

Referring now to FIG. 1, there is shown a pictorial diagram of a currency cartridge 9 installed within a dispensing machine 11. The currency cartridge 9 is contained within a housing 13 which completely surrounds and encloses the reel supply 15 of currency and the operating components, later described herein, to form a secure cartridge that has only an exit port 17 for currency and a connector 19 for control signals Units of currency 21 which are to be dispensed pass through an exit chute 23 and exit port 17 of the cartridge 13, and through a security port 25 of the machine 11 which is designed using conventional technology to eject dispensed currency and to inhibit unauthorized intrusion by foreign objects.

Figure 2:
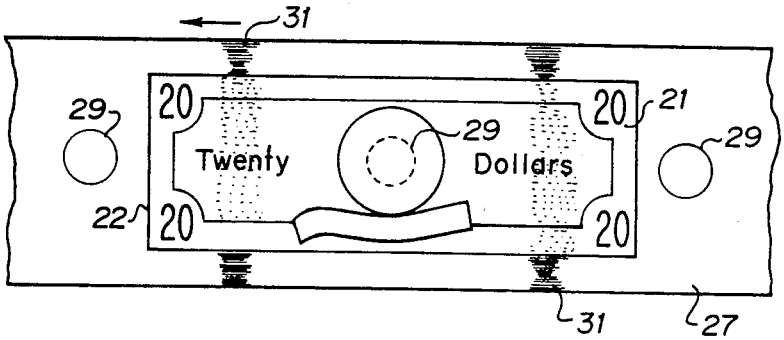
FIG. 2 is a perspective view of a transport medium and attached unit of currency.

The reel supply 15 of currency 21 includes a transport medium or web 27 of material such as Mylar or paper, or the like, of high tensile strength which has detector apertures 29 disposed at regular increments along the length of the medium 27. As shown more specifically in FIG. 2, the medium 27 (which may be wider or narrower than the currency unit) includes adhesive regions 31 positioned at regular increments along the length of the medium at locations relative to the detector apertures 29 which facilitate attaching each unit of currency 21 to the medium 27 in registration over a corresponding aperture 29. The length of transport medium 27 with units of currency 21 adhesively (but removably) attached thereto is wound onto reel 15 or otherwise packed (as by zig-zag stacking, or the like) for selective unwinding or unpacking of the units of currency, as required to dispense the units 21. The medium 27 is attached to each unit of currency 21, as by conventional gummy, pressure-sensitive adhesive, at a location on each unit that is remote or back from the leading edge 22. Thus, the unit of currency 21 lays substantially in parallel-plane relationship to the medium 27 (referred to herein as coplanar relationship) and can be "peeled" off the medium 27 by bending the medium 27 away from the unit 21. This bending is accomplished by moving the medium 27 over roller 33. Because of the inherent rigidity of paper currency units 21 (even in used units), the leading edge 22 of a unit 21 "peels" away from medium 27 as it passes over roller 33 and can be gripped by a pair of rollers 35, 37 which exerts a continuing force on the unit 21 in a direction that diverges or strips away from the direction of movement of medium 27. An idler roller 39 may be mounted to pinch the medium 27 against roller 33 and to drive the rollers 35, 37 so that the surface velocities of these moving elements are the same and are controlled by the take-up reel 41 and the drive 43 coupled thereto. A unit of currency 21 which is thus stripped or peeled away from the medium 27 is ejected through the exit chute 23 and exit port 17 of the cartridge and can be transported through a conventional security port 25 of the machine 11 to the recipient. The incremental length of medium 27 moved sufficiently to eject one currency unit 21 is wound onto take-up reel 41.

Of course, more than one supply reel 15, 15′ may be included within the same cartridge 13 where it is desirable to dispense currencies in combinations of different denominations. In that event, one supply reel 15, 15′ contains currency units of a different denomination than is contained in other supply reels and each such supply reel of currency units is included within an independently operable system of elements (deleted for clarity) similar to the one system described herein in connection with reels 15, 41, rollers 33, 35, 37, 39, etc. Also, it should be recognized that paper money, scrip, traveler's checks, coins and other tokens of value should be considered in the term currency as used herein.

Figure 3:
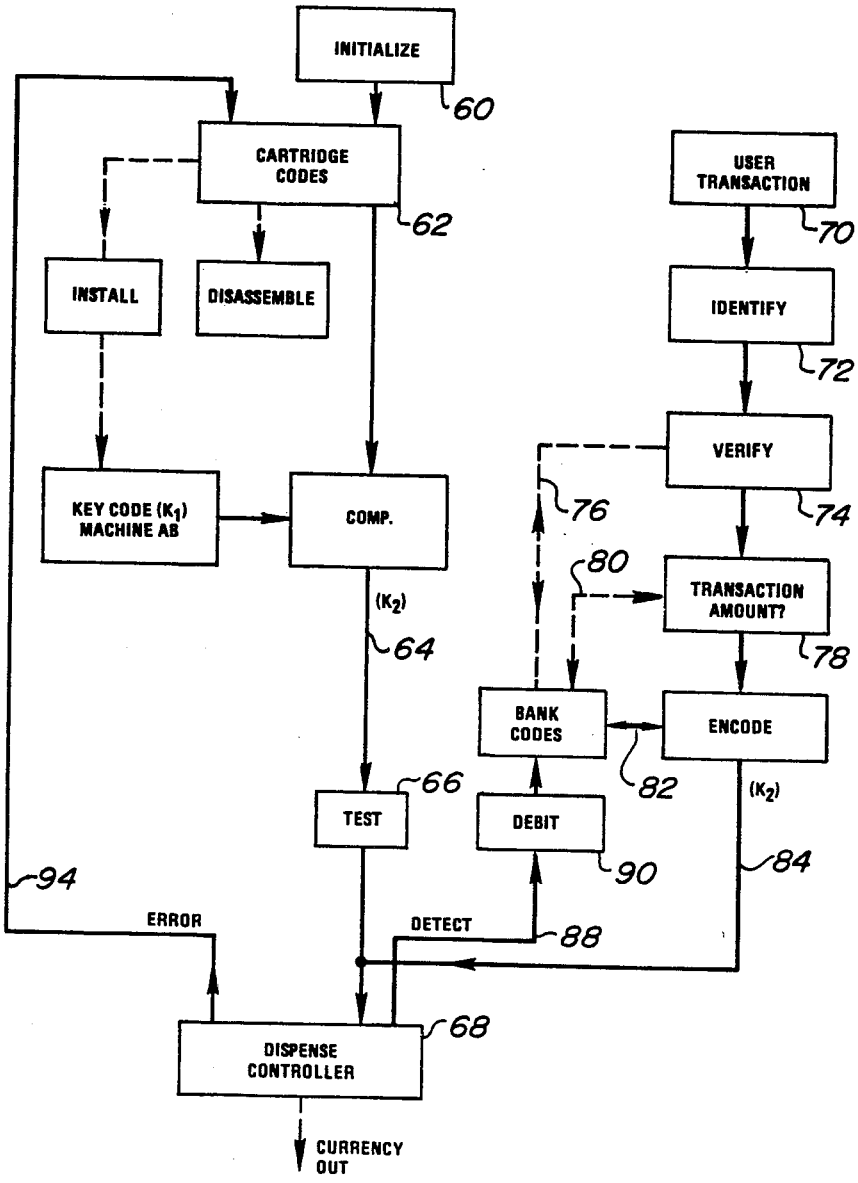
FIG. 3 is a flow chart showing the logical control of the currency cartridge.

The take-up reel 41 and drive means 43 coupled thereto are operated incrementally in response to signals supplied by the cartridge control 44. As illustrated in the flow chart of Figure 3, operation of the cartridge 13 may be in response to an initializing mode or a user-transaction mode. In the initializing mode 60, a cartridge 13 newly prepared with units of currency, as later described in connection with FIG. 4, may be scheduled to be installed in a selected machine 11 which has a known key code ($K_1$) associated therewith. The cartridge control 44 may be encoded 62 in conventional manner to include a security code which renders the cartridge 13 operable 64 only when installed in machine 11 and properly connected to its control 46 via connectors 19, 45. To establish the proper installation and operation of a cartridge 13, the assembly may be tested 66 under control of cartridge control 44 and machine control 46 to dispense 68 the first unit of "currency" from the supply reel 15, which first unit may be dummy currency that is actually a receipt to evidence proper installation of the cartridge 13 in the selected machine 11.

In the user transaction mode 70, a user who was previously identified by the bank or other proprietor of the currency dispensing machine 11 and who has an account on file can identify himself 72 by his own code word at the location of machine 11 using conventional interface means 47 such as credit-card reader, keyboard, etc. The user's identity may then be verified 74, either off-line or in interactive connection 76 with the bank, using conventional algorithms, for example, as disclosed in U.S. Pat. Nos. 3,938,091 or 4,328,414. Once the identity of the user is verified, his requested amount of currency 78 may be checked at the bank 80 against the credit balance standing in his account, and the requisite control code 84 may be supplied to the cartridge control 44 to dispense 68 the requested amount of currency.

Cartridge control 44 thus is activated to perform several functions. The reel control 18, which locks the supply reel 15 against rotation, is activated to release or drive reel 15 to unwind the transport medium 27 with attached currency. In addition, take-up reel 41 is rotated by drive means 43 to wind up the transport medium 27. This motion of transport medium 27 continues until one or more units of currency sufficient to total the requested amount are "peeled" off the medium and dispensed.

To assure a proper accounting for the amount of currency actually dispensed, the pair of gripping rollers 35, 37 may be conductive and normally operated in conductive relationship to each other so that their conductive connection is interrupted as a unit of currency is being rolled through. This detection signal 88 (which can also be generated by optical or other suitable means) is indicative of currency actually dispensed and is used to initiate a debit 90 of the user's account. Of course, similar operation of other supply reels of currency of different denominations can also be controlled by cartridge control 44 in order to dispense a wider variety of amounts of currency consistent with an identified user's outstanding account credits.

If a unit of currency 21 is not peeled off the medium after it moves around roller 33 the detector 92, which include an optical source and detector, will indicate that the unit is still in position on the medium covering the associated aperture 29. In this event, no unit of currency would have been dispensed (or debited), as expected, and the unit of currency may simply be wound onto the take-up reel 41 as the drive means 43 continues to move the medium 27 an additional distance sufficient to dispense the required unit or units of currency. However, in accordance with one embodiment of the present invention, this detected error 94 in the operation of the cartridge 13 is applied to alter the cartridge code in a manner which indicates that currency is still contained within the cartridge. When the cartridge is later removed from machine 11 and returned to the bank for disassembly and reloading, this altered code may be detected via connector 19 as an indication that disassembly requires retrieval of currency in take-up reel 41.

Figure 4:
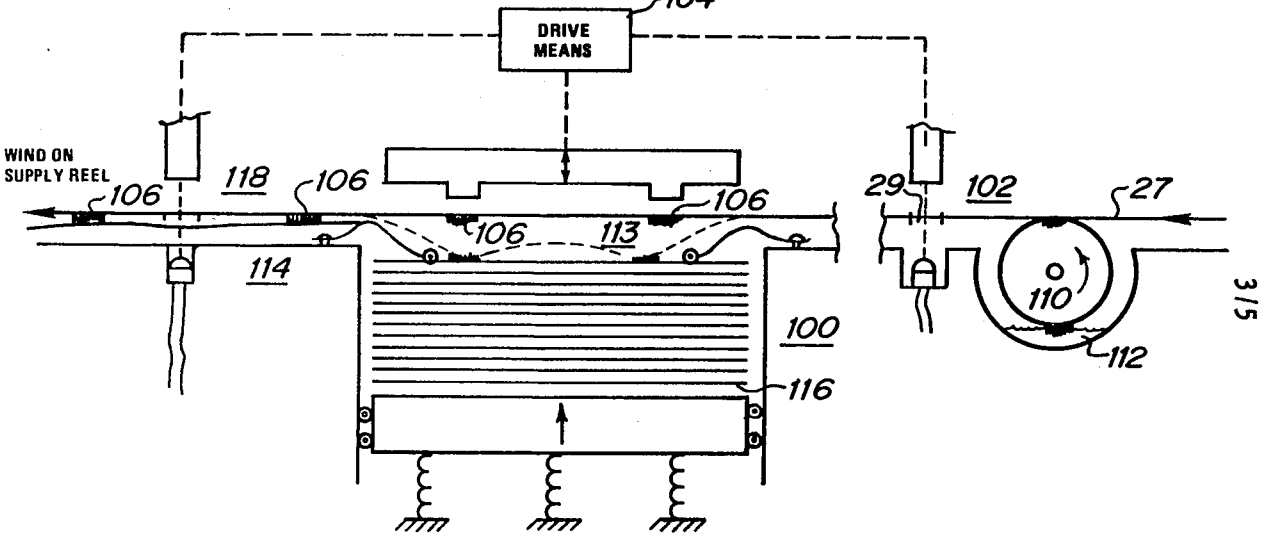
FIG. 4 is a pictorial view of apparatus for preparing units of currency for dispensing from the transport medium.

Referring now to FIG. 4, there is shown a work station at which a supply 100 of currency units is automatically assembled or stacked on the transport medium 27. Adhesive regions 106 are formed at regular intervals along the medium by roller 110 having raised applicator protrusions around its perimeter which pick up adhesive 112 and apply it as a lateral stripe 106 to the medium 27. Conventional, pressure-sensitive, gummy adhesives for this application are commonly available, for example, from 3M Company, Minnesota, and can be applied in continuous operation as disclosed. This adhesive adequately holds a unit of currency in gummy fixation upon the medium for easy "peeling" therefrom without damage to the currency.

A light source and detector 102 at the entrance side of the work station aligns with the apertures 29 and activates the drive means 104 to press the medium 27 with adhesive regions 106 onto the top unit of currency in the supply 100, as illustrated at 113. By this action, the top unit adheres to the medium 27 in position over the associated aperture 29 and with the leading edge (relative to the illustrated direction of movement of the medium 27) well in advance of the adhesive region 106. The units of currency are thus stacked on the medium 27 substantially in parallel-plane relationship 114 to the medium 27. The leading edge or forward boundary of each unit of currency is thus free to "peel" away from the medium 27 when the medium 27 is moved over roller 33, as previously described. The last unit of "currency" 116 attached to the medium 27 may be dummy currency or a receipt for test operation of the cartridge 13, as previously described. Light source and detector 118 may be located on the outlet side of the work station in alignment with the apertures 29 to provide error signal to the drive means 104 for suitably altering its operation in response to detection of an aperture 29 not covered by an adhered unit of currency.

Figure 5:
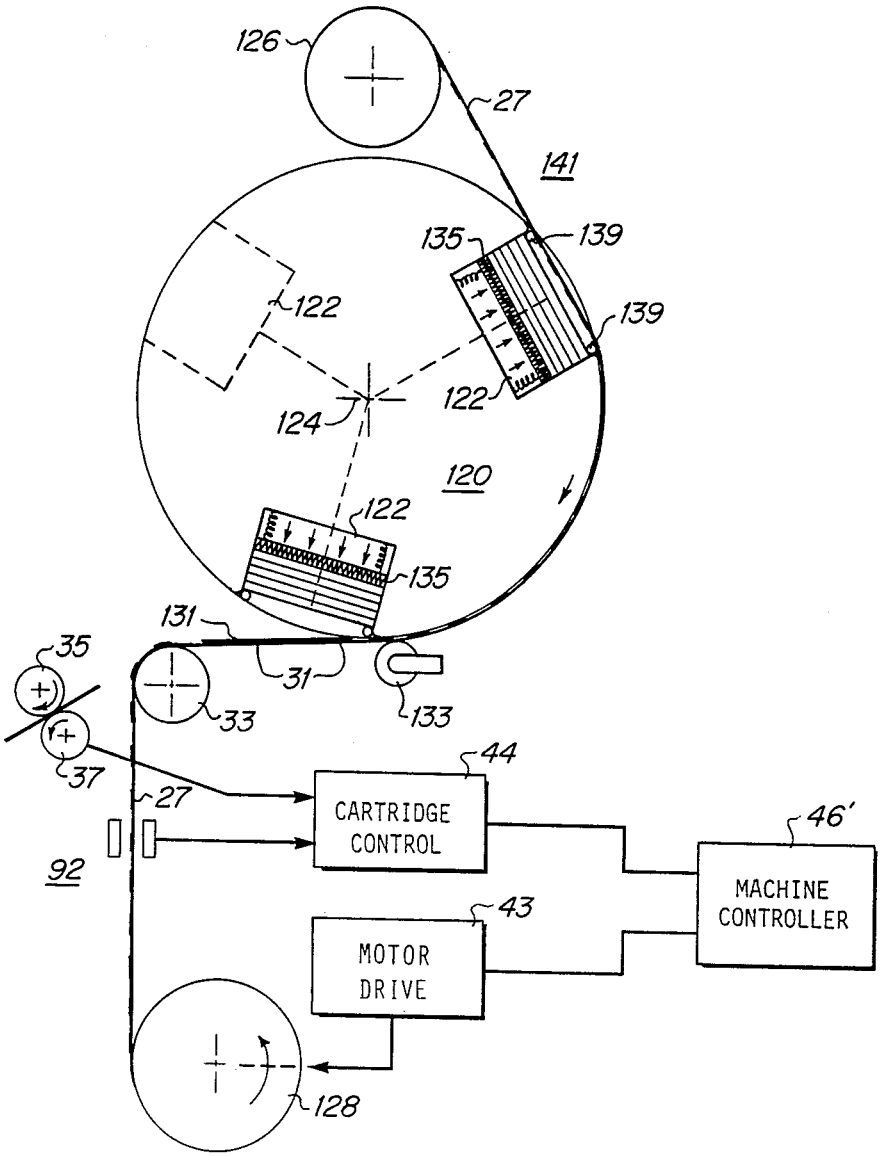
FIG. 5 is a pictorial diagram of a self-contained currency dispenser according to another embodiment of the present invention.

Referring now to the pictorial diagram of FIG. 5, there is shown a section of a currency canister 120 having a plural number of currency bins 122 disposed around the periphery of the canister. The currency canister 120 is mounted to rotate about the central axis 124 in response to the transport medium 27 moving along a path that contacts the perimeter of the canister 120. The surface velocity of the canister 120 is thus the same as the velocity of the transport medium 27 as the medium 27 is moved incrementally from supply reel 126 to take-up reel 128 under control of the motor drive 43. The path taken by the transport medium 27 between supply reel 126 and take-up reel 128 may alternatively pass over the top of the canister 120 (not shown) or pass in a continuous loop between supply and take-up reels 126, 128 (which serve as idler rollers) provided, however, that in each such embodiment the transport medium passes along and in contact with the periphery of th canister 120 with regions of adhesive carried by the transport medium 27, as previously described, disposed on the side thereof facing the periphery of the canister 120.

One or more currency bins 122 may be disposed about the periphery of the canister 120 to position one unit of currency from each bin 122 in a succession along the transport medium 27 at selected, spaced intervals. Regions of adhesive material 31, as previously described, are positioned along the transport medium to contact the outermost unit of currency in each bin 122 as the transport medium 27 and periphery of the canister 120 move together at the same surface velocity under control of the motor drive 43. A pressure roller 133 may be mounted on the opposite side of the transport medium 27 near the location along the path thereof where the periphery of the canister 120 and the transport medium 27 move along divergent paths. This roller 133 is resiliently biased to press the transport medium 27 and the adhesive material 31 carried thereby firmly against the outermost unit of currency in a bin 122 to assure that such outermost unit of currency adheres to the transport medium 27. Then, as the periphery of the canister 120 and the transport medium 27 progress along divergent paths, the adhered unit of currency 131 is extracted from the bin 122 and carried toward the rollers 33, 35 and 37 to be dispensed in the manner previously described.

Figure 6:
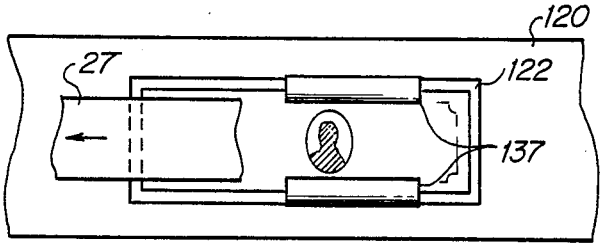
FIG. 6 is a plan view of one currency-confining aperture associated with a currency bin.
Figure 7:
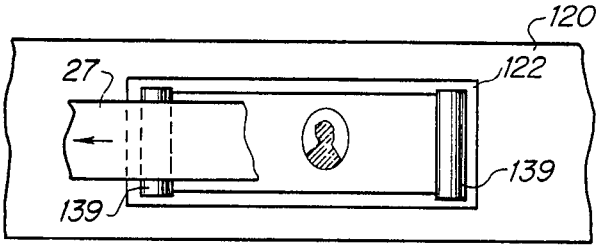
FIG. 7 is a plan view of another currency-confining aperture associated with a currency bin.

Referring additionally to FIGS. 6 and 7 there are shown plan views of two embodiments of currency-confining apertures associated with the currency bins 122 in the canister 120. In each embodiment the bin includes a resilient-biased platform 135 to urge the units of currency outwardly toward the surface as each outermost unit is extracted from the bin. In order to confine the stack of currency within the bin 122, the apertures shown in FIGS. 6 and 7 each include restrictors that reduce the cross section of the bin at the periphery of the canister 120. These restrictors thus impede the free-flow of currency out of the bin 122 as the canister 120 rotates about its axis 124. In FIG. 6, the restrictors include tabs 137 mounted at the sides of the bin 122 to extend inwardly sufficiently to overlay a portion of the width of a unit of currency. In FIG. 7, the restrictors include a pair of rollers 139 mounted across the ends of the bin transverse to the path of movement of the transport medium 27 also to overlay a portion of the length of a unit of currency.

In operation, the outermost unit of currency in a currency bin 122 contacts the adhesive material 31 carried by the transport medium 27 at the location 141 where the paths of the medium 27 and the periphery of the canister 120 converge. The periphery of the canister 120, the transport medium 27 and the adhered unit of currency all travel along substantially the same path at the same surface velocity past the pressure roller 133 which enhances the adhesion of the unit of currency to the medium 27. Thereafter, the paths of the periphery of canister 120 and medium diverge, and the adhered unit of currency 131 is extracted from the bin 122 by "peeling" the unit past the restrictors at the surface of the bin. As the movement continues, the extracted unit of currency 131 advances toward the dispensing rollers 33, 35 and 37, and the canister 120 rotates to position a successive bin 122 into position for extraction therefrom of the next unit of currency to be dispensed.

Equal numbers of units of currency may be loaded into the bins 122 in the canister 120, and the total number of such units may be entered into a memory register (not shown) in the machine controller 46'. The motor drive 43 may be operated incrementally through a number of currency-dispensing operations, under detection and control of the cartridge control in a manner similar to the operations previously described, until the number of dispensing operations equals the number entered in the memory register of controller 46'. Also any units of currency not properly dispensed and still adhering to the transport medium 27 in take-up reel 128, as detected by cartridge control 44 in the manner previously described, can provide indication of the number of units of currency to be retrieved from the take-up reel 128 before it is discarded.

It should be understood that the present invention includes other embodiments in which the unit of currency to be dispensed travels along a path substantially in contact with, and at the same velocity as, the transport medium. For example, a canister having a single currency bin 122 may be used where the canister is mounted only to shuttle angularly or translationally between an initial position and a terminal position with the outermost unit of currency in the bin in contact with, and moving at the same velocity as, the transport medium between such two positions. In such embodiments, the pressure roller 133 may be an active "pinch" roller that establishes contact between the transport medium and a unit of currency during shuttling of the canister between such two positions to assure adherence of the unit of currency to the transport medium. Thereafter, the transport medium need not be retained in contact with currency in the bin as the canister returns to its initial position for subsequent shuttle movement, as previously described.

Therefore, the currency dispenser and method of the present invention provide units of currency to users at remote locations under conditions that insure high degrees of security upon installation and operation. In addition, currency-dispensing cartridges according to the present invention may directly supply units of currency in different selected denominations for greater versatility compared with conventional prepackaged packets of currency. Also, the improved dispensing scheme with internal self-loading permits a stack of currency to be dispensed a unit at a time without the need for preloading at a remote station.

What is claimed is:

1. Apparatus for selectively dispensing units of currency, comprising:

housing means for confining a quantity of units of currency to be dispensed in a configuration from which single units of currency are extractable in succession;

means supporting said housing means for movement of the units of currency confined thereby between first and second positions;

transport means having isolated adhesive regions disposed along the length thereof and being supported for movement selectively along a path that passes adjacent the quantity of units of currency between said first and second positions; and means operable with said housing means to engage selected ones of said adhesive regions and a single unit of currency of said quantity thereof, and to move said single unit and said transport means substantially along said path at the same velocities between said first and second positions to adhesively attach said single unit and said transport means.

2. Apparatus as in claim 1 wherein:

said housing means is mounted for angular movement about an axis and includes a selected number of currency bins disposed substantially radially outwardly from said axis to confine therein a stack of units of currency to be dispensed; and said transport means is supported for surface engagement with the outermost unit of currency in a currency bin.

3. Apparatus as in claim 2 wherein:

said housing means includes a substantially cylindrical canister mounted for rotation about an axis and having a plural number of currency bins substantially radially oriented within the periphery thereof to contain a stack of currency therein with the outermost unit thereof located substantially at the periphery of the canister; and said transport means includes a length of web material supported substantially to engage the periphery of the canister at least over an angular portion thereof in which the outermost unit of currency in a currency bin is located.

4. Apparatus as in claim 4 comprising restrictor means disposed in each of the currency bins near the outer limit thereof to overlay a portion of currency disposed within the bin to inhibit free outward movement therefrom.

5. The method of selectively dispensing units of currency from a stacked supply of such currency, comprising the steps of:

moving the stacked supply of currency to transport the outermost unit of currency along a path between first and second locations;

simultaneously moving a transport medium along said path between the first and second locations at substantially the same velocity and in surface contact with said outermost unit;

adherently attaching the outermost unit of currency to the transport medium during the movement thereof between the first and second locations; and separating the outermost unit of currency from the stacked supply in response to continued movement of the transport medium and attached unit along divergent paths beyond the second location.

6. The method according to claim 5 wherein in the step of moving, the outermost unit is transported in substantially angular rotation about an axis between the first and second locations.

7. The method according to claim 5 comprising the step of:

yieldably inhibiting the separation of the outermost unit of currency from the stacked supply to establish separation only in response to said continued movement with the outermost unit adherently attached to the transport medium.

* * * * *